US007681318B2

(12) United States Patent
Hsieh

(10) Patent No.: US 7,681,318 B2
(45) Date of Patent: Mar. 23, 2010

(54) POWER-SAVING SCISSORS

(75) Inventor: Chih-Ching Hsieh, Tai-Chung Hsien (TW)

(73) Assignee: Chihching Hsieh, Tai-Chung Hsien (TW)

( * ) Notice: Subject to any disclaimer, the term of this patent is extended or adjusted under 35 U.S.C. 154(b) by 141 days.

(21) Appl. No.: 11/858,136

(22) Filed: Sep. 20, 2007

(65) Prior Publication Data

US 2008/0005909 A1 Jan. 10, 2008

Related U.S. Application Data

(63) Continuation-in-part of application No. 11/151,577, filed on Jun. 14, 2005, now abandoned.

(51) Int. Cl.
*B26B 13/00* (2006.01)

(52) U.S. Cl. ..... 30/244; 30/245; 30/252; 30/186; 30/187

(58) Field of Classification Search ..... 30/245, 30/244, 247, 266, 186, 187, 191, 192, 254, 30/255, 188, 252, 248, 249, 272.1; 81/342
See application file for complete search history.

(56) References Cited

U.S. PATENT DOCUMENTS 1,708,768 A * 4/1929 Marsik ..... 56/247
1,713,393 A * 5/1929 Moore ..... 30/247
3,052,980 A * 9/1962 Fieser ..... 30/228
6,789,324 B2 * 9/2004 Linden et al. ..... 30/245
6,938,346 B1 * 9/2005 Huang ..... 30/250
7,093,364 B2 * 8/2006 Hsieh ..... 30/90.1
7,168,168 B2 * 1/2007 Hsieh ..... 30/252

* cited by examiner

*Primary Examiner*—Boyer D Ashley
*Assistant Examiner*—Omar Flores-Sánchez

(57) ABSTRACT

A power-saving scissors comprises a first handle having a first knife set; the first handle being formed with a receiving space; an inner wall of the receiving space being formed with teeth; a second handle pivotally installed to the first handle by a planet gear set; the second handle having a second knife set; a center gear being protruded from the second handle at a position corresponding to the receiving space; the center gear being engagable with the receiving space of the first handle; the planet gear set including the center gear, three peripheral gears and a cover; one end of the center gear being installed to the second handle and another end thereof being protruded with a post; the three peripheral gear being respectively engaged to the center gear and also engaged to the teeth of the receiving space.

4 Claims, 8 Drawing Sheets

POWER-SAVING SCISSORS

The present invention is a continuation in part of U.S. patent Ser. No. 11/151,577 filed Jun. 14, 2005 now abandoned which is assigned and invented to the applicant and inventor of the present invention, and thus the contents of the invention are incorporated into the present invention as a part of the present invention.

FIELD OF THE INVENTION

The present invention relates to scissors, and in particular to a set of power-saving scissors, wherein a planet gear set is installed between the connection of the two handles of the scissors to achieve the object of power saving. Furthermore, in the present invention, the planet gear set is sealed within receiving space by the cover. It will not expose out and thus is not polluted.

BACKGROUND OF THE INVENTION

The prior art scissors have two handles, which are pivotal installed to each other. By rotating one handle, the other handle will rotate with respect to the handle. If it is desired to cut a hard object, the user must apply a great force to the handle. There is no mechanism which can make the user apply less force to the scissors.

SUMMARY OF THE INVENTION

Accordingly, the primary object of the present invention is to provide a set of power-saving scissors, wherein a planet gear set is installed between the connection of the two handles of the scissors to achieve the object of power saving. Furthermore, in the present invention, the planet gear set is sealed within receiving space by the cover. It will not expose out and thus is not polluted.

To achieve above objects, the present invention provides a power-saving scissors which comprises a first handle having a first knife set; the first handle being formed with a receiving space; an inner wall of the receiving space being formed with teeth; a second handle pivotally installed to the first handle by a planet gear set; the second handle having a second knife set; a center gear being protruded from the second handle at a position corresponding to the receiving space; the center gear being engageable with the receiving space of the first handle; the planet gear set including the center gear, three peripheral gears and a cover; one end of the center gear being installed to the second handle and another end thereof being protruded with a post; the three peripheral gears being respectively engaged to the center gear and also engaged to the teeth of the receiving space; the cover covering upon an outer side of the receiving space so as to seal the planet gear set within the receiving space.

The various objects and advantages of the present invention will be more readily understood from the following detailed description when read in conjunction with the appended drawing.

DETAILED DESCRIPTION OF THE INVENTION

Figure 1:
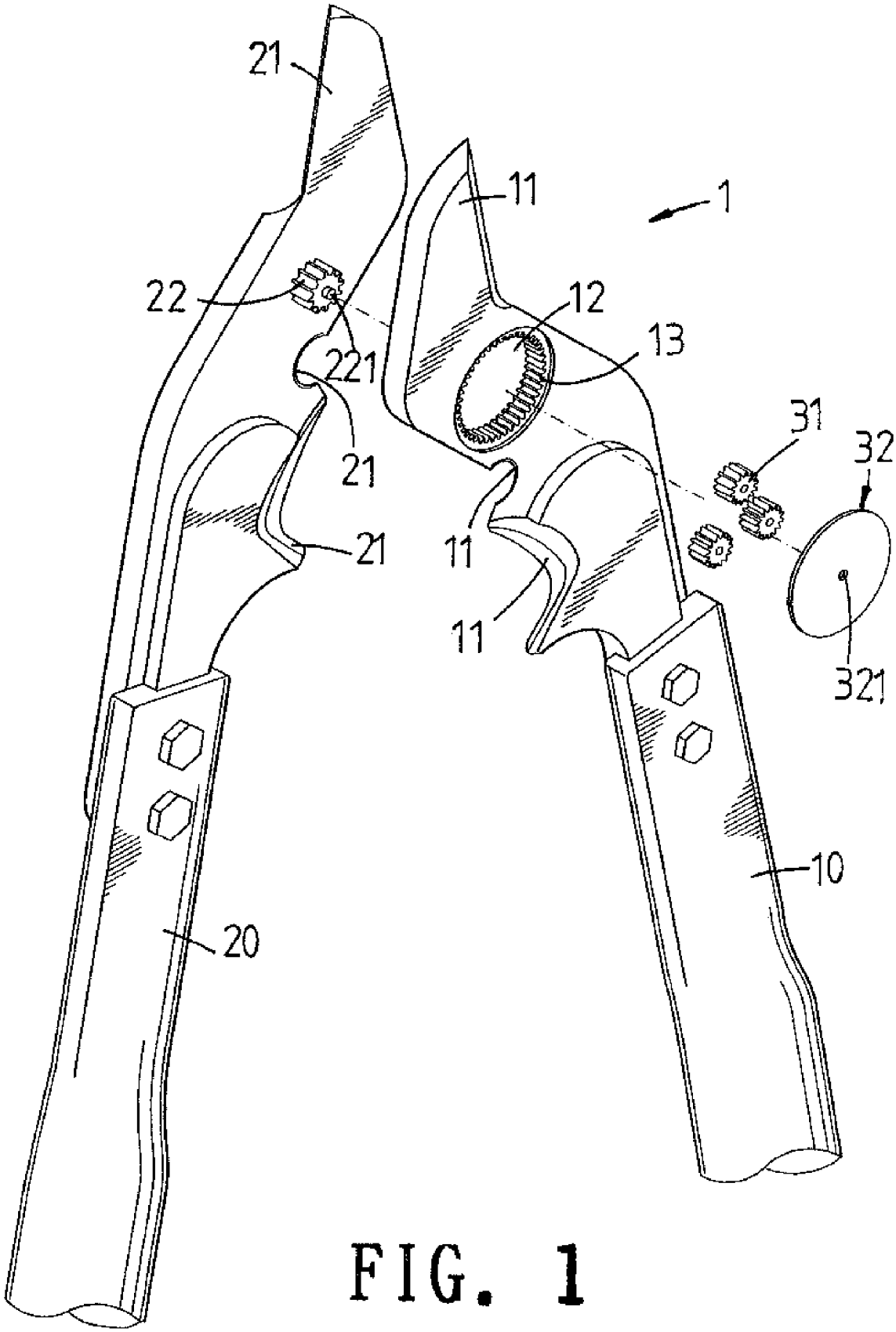
FIG. 1 is an exploded view of the power-saving scissors of the present invention.
Figure 2:
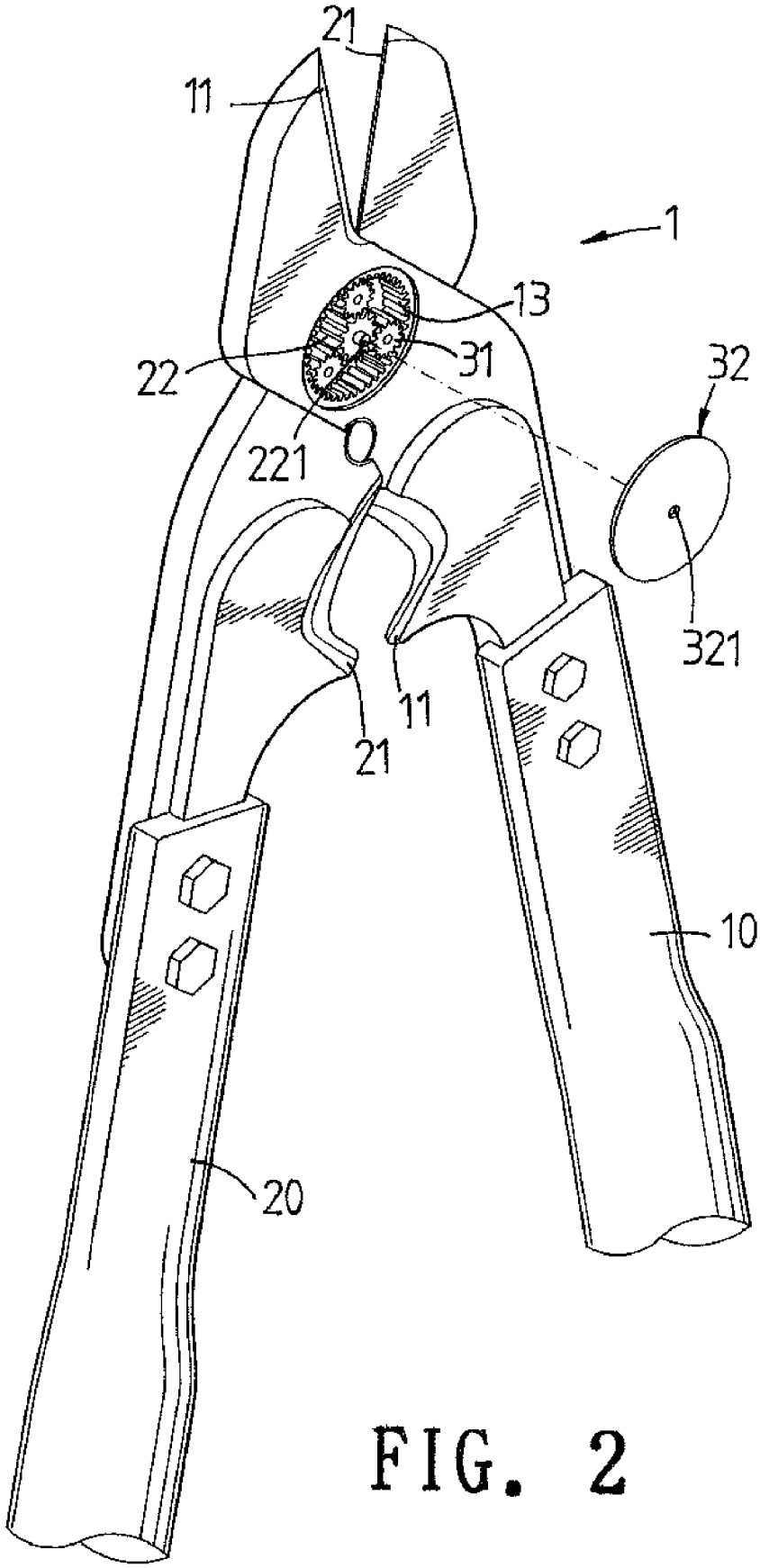
FIG. 2 is a perspective view about the power-saving scissors of the present invention.
Figure 3:
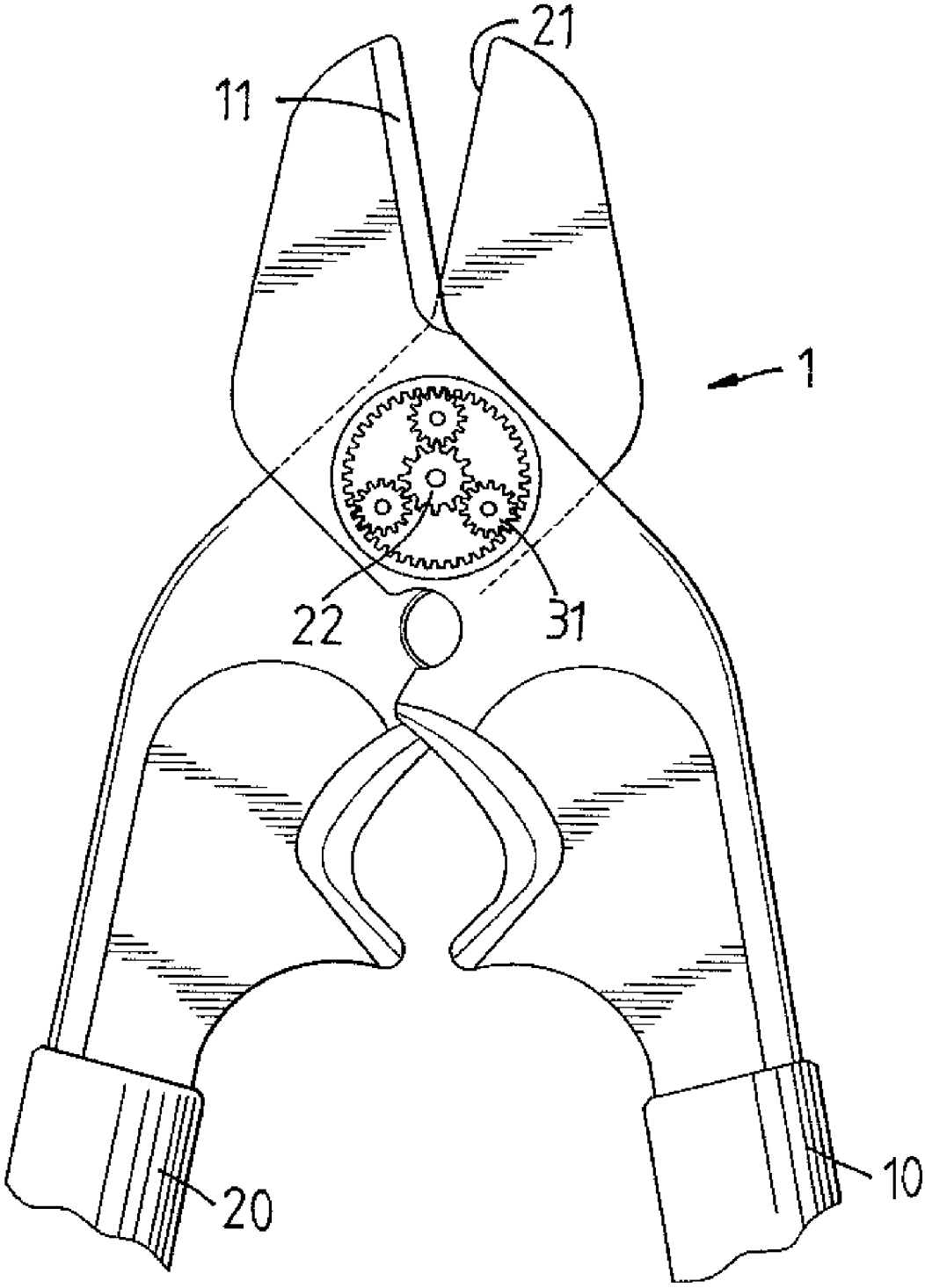
FIGS. 3 and 4 are lateral view about the power-saving scissors of the present invention.
Figure 4:
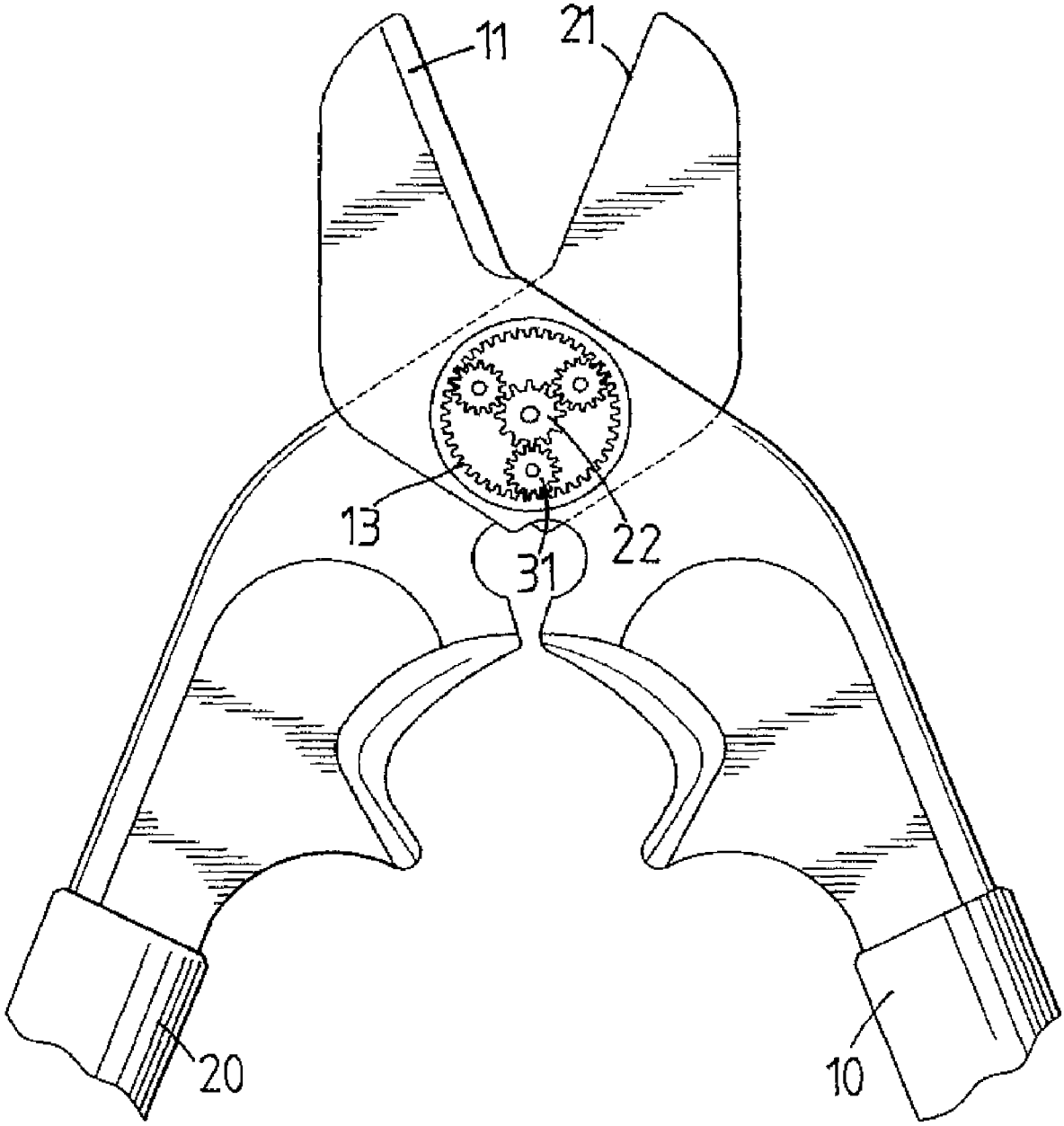
Figure 5:
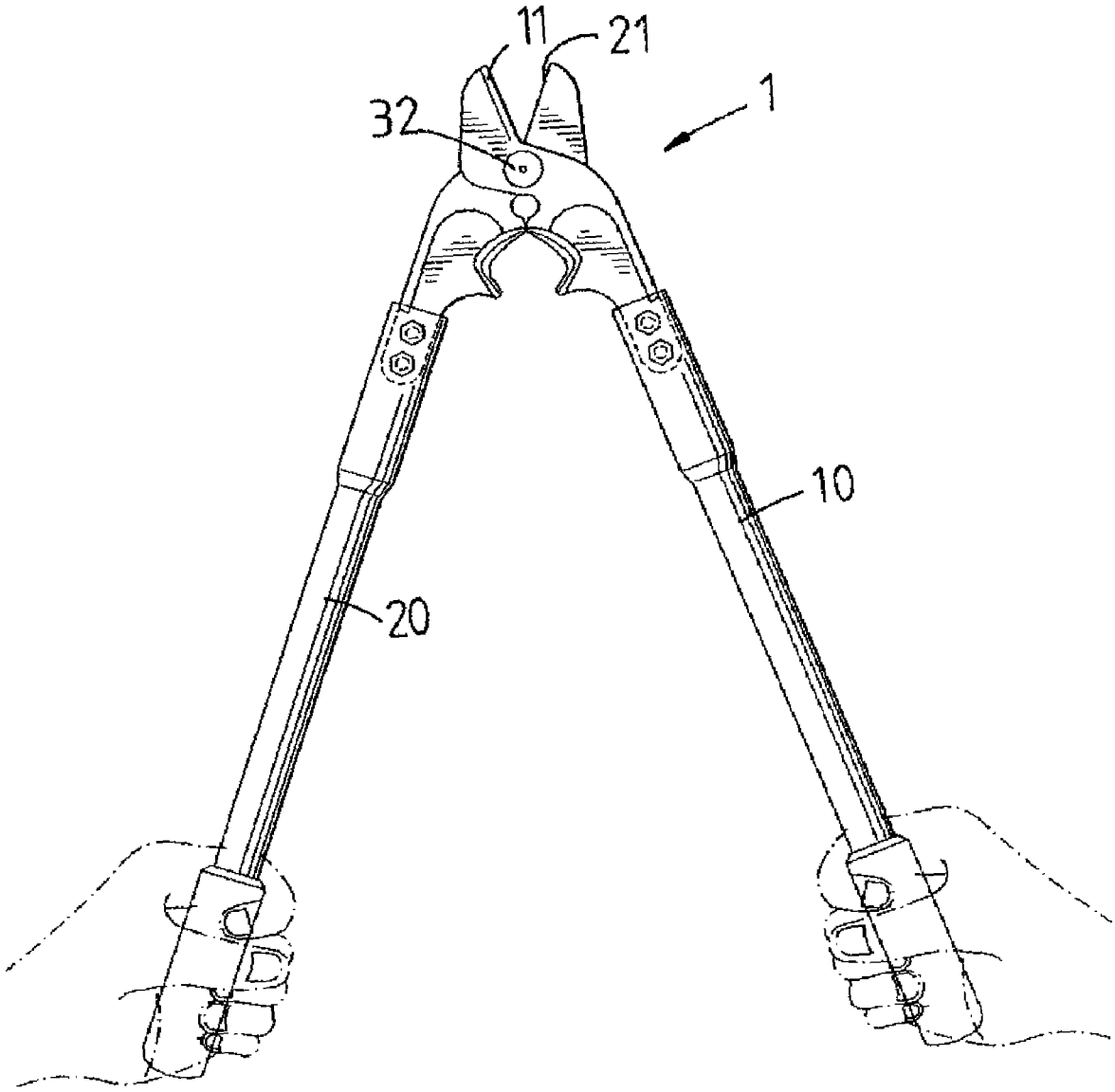
FIGS. 5 and 6 are schematic view about the use of the power-saving scissors of the present invention.
Figure 6:
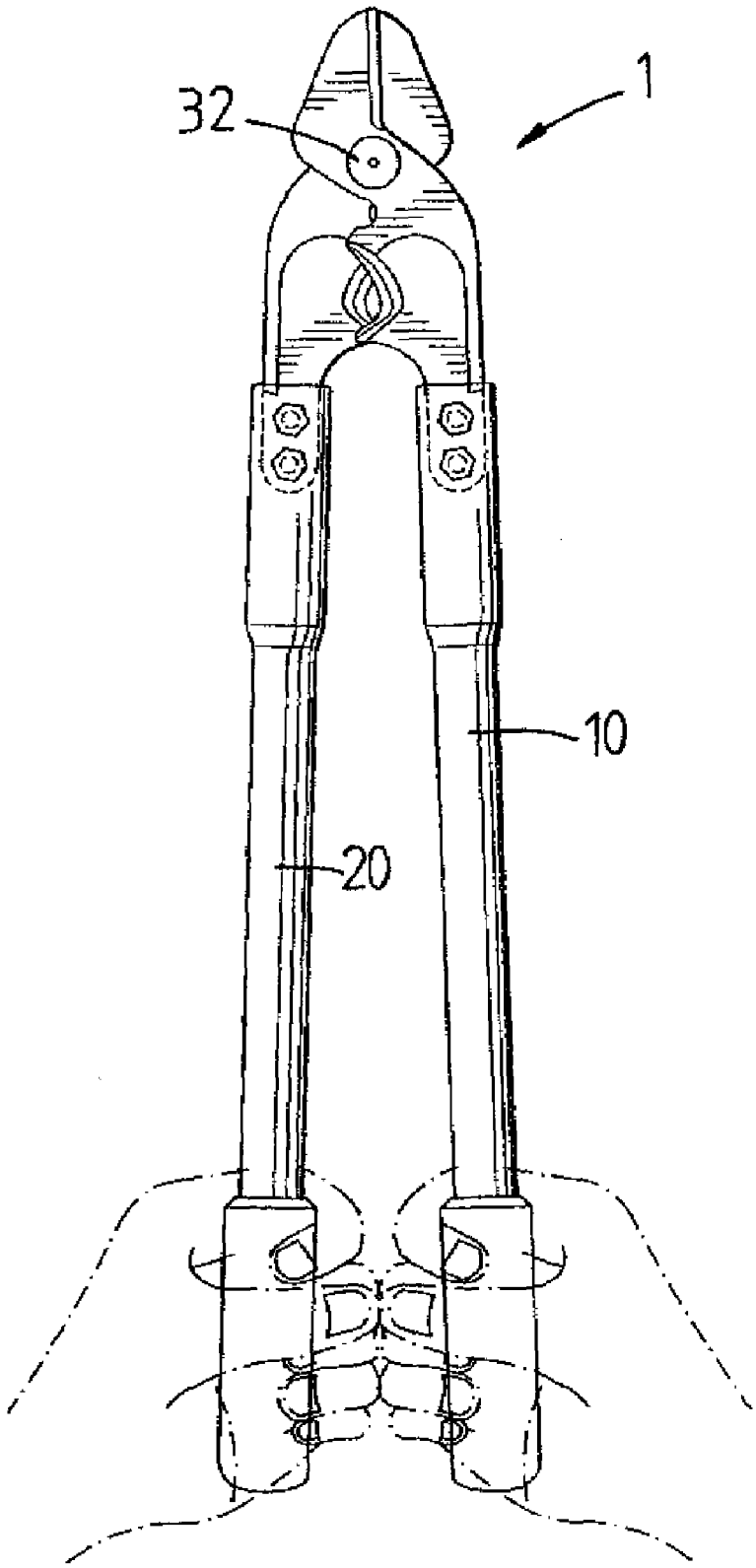

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the power-saving scissors of the present invention is illustrated. The power-saving scissors has a scissor body 1. The scissor body 1 has the following elements.

A first handle 10 has a first knife set 11. The first handle 10 is formed with a receiving space 12. An inner wall of the receiving space 12 is formed with teeth 13.

A second handle 20 is pivotally installed to the first handle 10 by a planet gear set. The second handle 20 has a second knife set 21. In this embodiment, each of the first and second knife sets 11, 21 has three blades. When the first handle 10 and second handle 20 rotate with respect to each other, the first knife set 11 and second knife set 21 will perform cut operations. A center gear 22 is protruded from the second handle 20 at a position corresponding to the receiving space 12. The center gear 22 is engageable with the receiving space 12 of the first handle 10.

The planet gear set includes the center gear 22, three peripheral gears 31 and a cover 32. One end of the center gear 22 is installed to the second handle 20 and another end thereof is protruded with a post 221. The three peripheral gears 31 are engaged to the center gear 22 and also engaged to the teeth 13 of the receiving space 12. The cover 32 is installed with a buckling hole 321 for receiving the post 221 of the center gear 22.

The planet gear set includes the center gear 22, three peripheral gears 31 and a cover 32. One end of the center gear 22 is installed to the second handle 20 and another end thereof is protruded with a post 221. The three peripheral gears 31 are engaged to the center gear 22 and also engaged to the peripheral teeth of the receiving space 12. The cover 32 is installed with a buckling hole 321 for receiving the post 221 of the center gear 22.

In assembly, the cover 32 of the scissor body 1 is placed into the receiving space 12 of the first handle 10. Then the three peripheral gears are placed between the center gear 22 and the teeth of the receiving space 12. Then the cover 32 covers upon the receiving space 12 to cause that the post 221 of the center gear 22 is buckled into the buckling hole 321 of the cover 32. Thus the assembly work of the present invention is completed. After assembly, when the second handle 20 rotates, the center gear 22 also rotates to drive the peripheral gears 31 so as to drive the first handle 10. Thus, the first handle 10 and second handle 20 rotate with respect to one another to cut an object.

Referring to FIGS. 3 to 6, in use, the center gear 22 of the second handle 20 will drive the peripheral gears 31 so as to rotate the teeth 13 on the receiving space 12 of the first handle 10. The number of the teeth of the center gear 22 is far smaller than number of the teeth in the teeth 13 so as to achieve the object of power saving. Furthermore, in the present invention, the planet gear set is sealed within receiving space 12 by the cover 32. It will not expose out and thus is not polluted.

Figure 7:
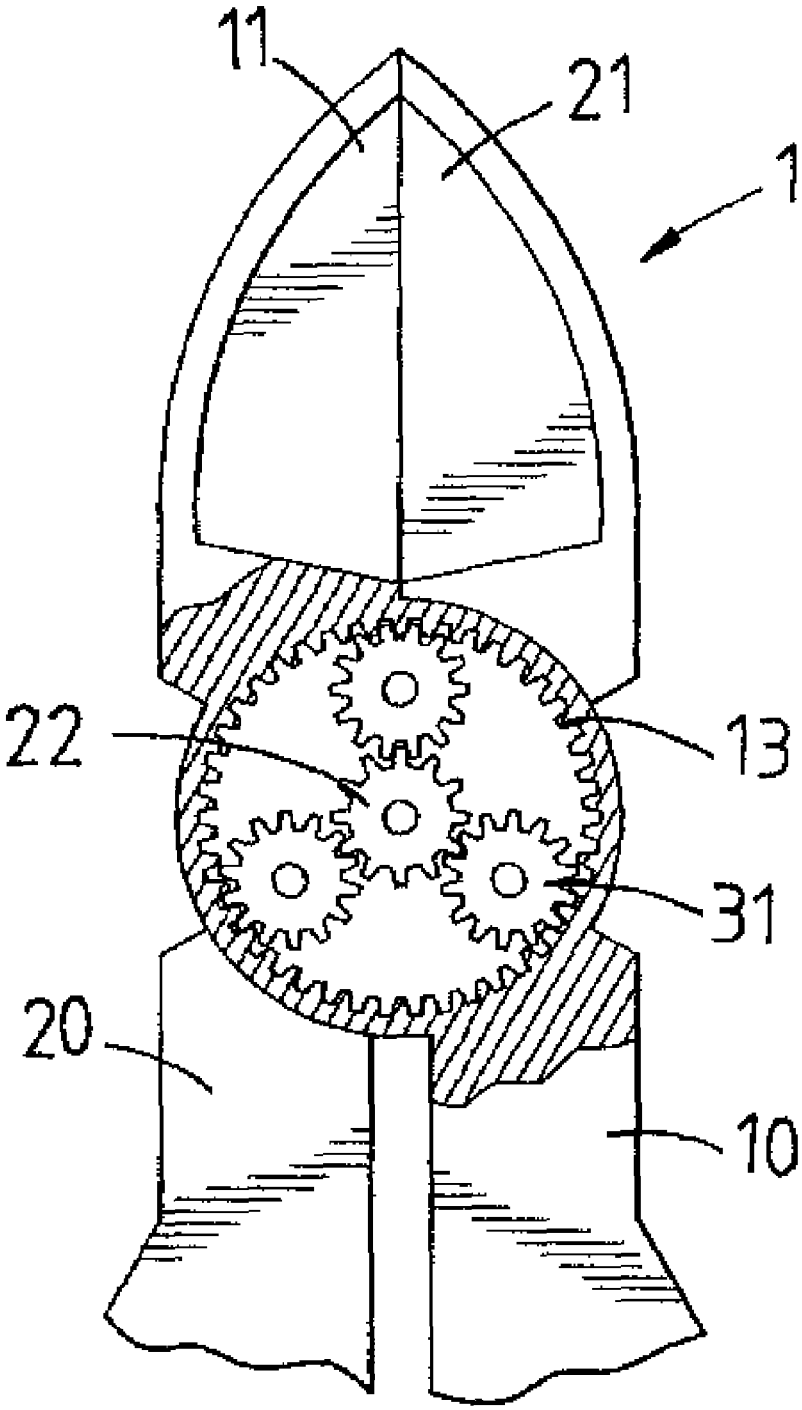
FIG. 7 shows a partial schematic view of the second embodiment of the power-saving scissors of the present invention.
Figure 8:
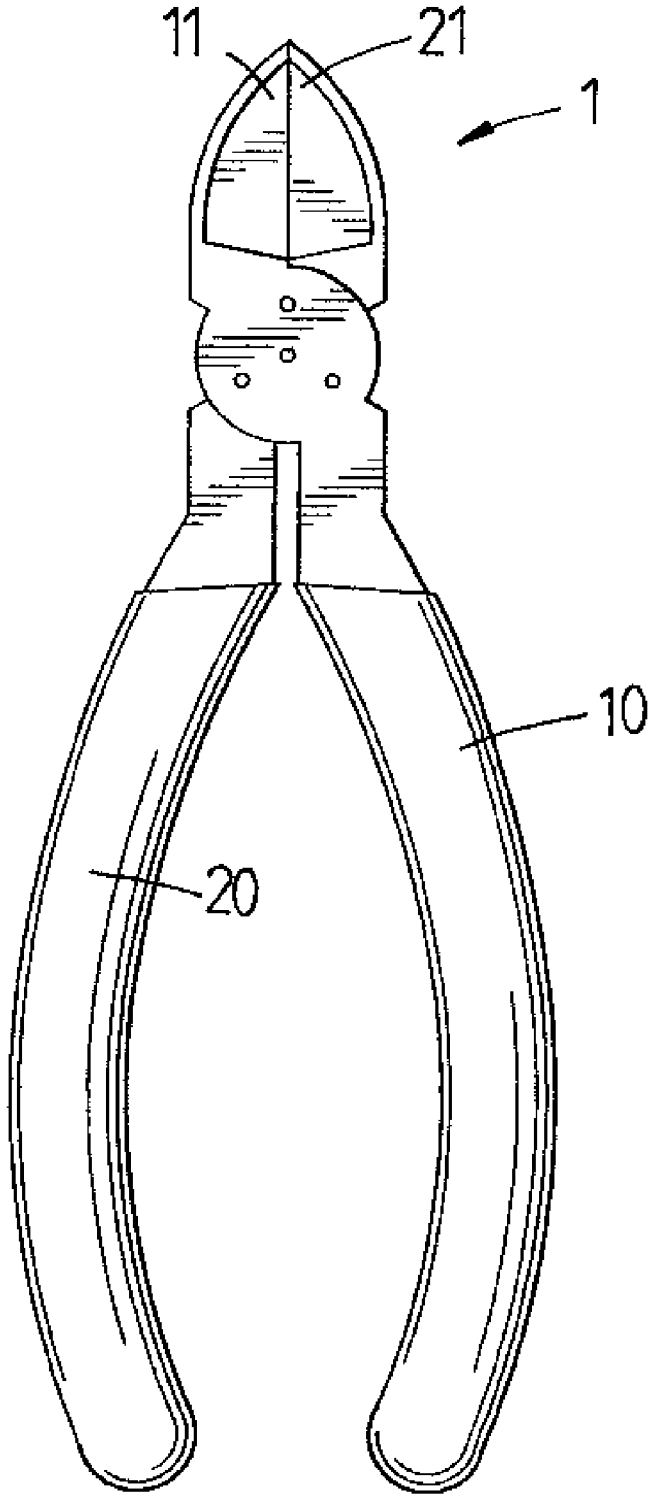
FIG. 8 is a schematic view about the second embodiment of the present invention.

Referring to FIGS. 7 and 8, the second embodiment of the present invention is illustrated. Those identical to the first embodiment will not be described herein. Only those different will be described herein. In this the present invention, the scissor body 1 is formed as a set of pliers.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A power-saving scissors comprising:

a first handle having a first knife set formed on the second handle; the first handle being formed with a receiving space; an inner wall of the receiving space being formed with teeth;

a second handle pivotally installed to the first handle by a planet gear set; the second handle having a second knife set; a gear being protruded from the second handle at a position corresponding to the receiving space; the center gear being located within the receiving space of the first handle;

the planet gear set including the center gear, at least one peripheral gear and a cover; one end of the center gear being installed to the second handle and another end thereof being protruded with a post; the three peripheral gears being engaged to the center gear and also engaged to the teeth of the receiving space; the cover covering upon an outer side of the receiving space so as to seal the planet gear set within the receiving space;

wherein at a side of the first knife set near the second knife set, the first knife set has an upper knife above the receiving space, a middle round concave knife below the receiving space and a lower knife below the second concave knife; at a side of the second knife set near the second knife set, the second knife set has an upper knife above the center gear, a middle round concave knife below the receiving space and a lower knife below the second concave knife.

2. The power-saving scissors as claimed in claim 1, wherein the scissor is a set of pliers.

3. The power-saving scissors as claimed in claim 1, wherein the cover is formed with a buckling hole for receiving the post of the center gear; the cover covers upon an outer side of the receiving space; and the post of the center gear inserts into the hole of the cover.

4. The power saving scissor as claimed in claim 1, wherein the planet gear set further includes a cover; one end of the center gear is installed to the second handle and another end thereof is protruded with a post; the three peripheral gears are engaged to the center gear and also engaged to the peripheral teeth of the receiving space; the cover is installed with a buckling hole for receiving the post of the center gear.

* * * * *